US006592062B1

(12) United States Patent
Virving

(10) Patent No.: US 6,592,062 B1
(45) Date of Patent: Jul. 15, 2003

(54) REFINING ELEMENT

(75) Inventor: Nils Virving, Hässelby (SE)

(73) Assignee: Valmet Fibertech AB (SE)

( * ) Notice: Subject to any disclaimer, the term of this patent is extended or adjusted under 35 U.S.C. 154(b) by 0 days.

(21) Appl. No.: 09/936,197

(22) PCT Filed: Mar. 3, 2000

(86) PCT No.: PCT/SE00/00420

§ 371 (c)(1),
(2), (4) Date: Sep. 10, 2001

(87) PCT Pub. No.: WO00/56459

PCT Pub. Date: Sep. 28, 2000

(30) Foreign Application Priority Data

Mar. 19, 1999 (SE) ..... 9901020

(51) Int. Cl.[7] ..... B02C 7/12
(52) U.S. Cl. ..... 241/261.3; 241/296; 162/261
(58) Field of Search ..... 162/20, 23–28, 162/234–236, 261; 241/28, 261.2, 261.3, 296–298

(56) References Cited

U.S. PATENT DOCUMENTS

| | | | | | |
|---|---|---|---|---|---|
| 4,712,745 | A | * | 12/1987 | Leith | 241/261.3 |
| 4,767,065 | A | * | 8/1988 | Wray | 241/152.2 |
| 5,046,672 | A | * | 9/1991 | Demler | 241/296 |
| 5,181,664 | A | | 1/1993 | Kohler | 241/261.3 |
| 5,467,931 | A | * | 11/1995 | Dodd | 241/261.2 |
| 5,690,286 | A | * | 11/1997 | Dodd et al. | 241/296 |
| 5,704,559 | A | * | 1/1998 | Froberg et al. | 241/261.3 |
| 6,042,036 | A | | 3/2000 | Virving et al. | 241/261.3 |
| 6,227,471 | B1 | | 5/2001 | Virving | 241/244 |
| 6,276,622 | B1 | | 8/2001 | Obitz | 241/261.3 |

* cited by examiner

*Primary Examiner*—Steven P. Griffin
*Assistant Examiner*—Eric Hug
(74) *Attorney, Agent, or Firm*—Lerner, David, Littenberg, Krumholz & Mentlik, LLP

(57) ABSTRACT

Refining elements for use in a disk refiner are provided, in which the refining elements include an outer surface with a plurality of raised bars separated by grooves, the raised bars including an upper surface having a first longitudinal edge and at least one step defining a second longitudinal edge at an intermediate height between the first longitudinal edge and the outer surface of the refining element.

16 Claims, 1 Drawing Sheet

REFINING ELEMENT

This invention relates to refiners of disc-type with opposed refining discs rotating relative to each other. The refining discs ale provided with refining elements, which between themselves form a refiner gap with a refiner zone for the working of fibrous material. The fibrous material preferably is lignocellulosic fiber material and the refiner is used for manufacturing, for example, reject pulp, recycled fiber pulp and mechanical pulps such as board pulp, thermomechanical pulp (TMP) and chemi-thermomechanical pulp (CTMP) as well as chemical pulps.

The invention, more precisely, relates to a refining element for use in a refiner of the aforesaid type.

A refining element is designed with a pattern of bars and intermediate grooves. The bars and grooves are formed in different ways, depending on the fibrous material to be worked and on the degree of working and thereby, in the case of lignocellulosic material, on the pulp quality desired. The bars, for example, can be continuous or discontinuous and arranged in different patterns.

The refiner gap is designed so that the fibrous material shall pass from the inside out, seen in radial direction. Farthest inward in the refiner gap the refining elements normally are designed to bring about a first disintegration of the material and to advance the material further outward in the refiner gap. A certain defibration, i.e. separation of the fibers of the lignocellulosic material, also takes place in the inner portion of the refiner gap where the distance between the refining surfaces is greatest. Thereafter the distance decreases outward for achieving the desired working of the fibrous material.

The working of the fibrous material is carried out substantially by the bars of the refining elements. Their design, thus, is of essential importance for the pulp quality. Other factors of influence on the pulp quality are, for example, the size of the refiner gap, the liquid contents in the fibrous material, the feed, temperature etc.

The bars have an upper surface with edges. At the working of the fibrous material the bars are worm, especially their edges, which thereby get round. In cases where one refiner disc is stationary, its bars most often get worn most, because the difference in speed between the fibrous material and stationary refiner disc is greater than the difference in speed between the fibrous material and rotating refiner discs.

The wear is caused above all by the fact that sand and other hard foreign particles follow along with the fibrous material into the refiner and, thus, into the refiner gap where they repeatedly come into contact with the bars of the refining elements.

The refiner discs normally have a rotation speed of up to 3000 revolutions per minute relative to each other, and the refiner gap normally has a size of about 0.2 to 2 mm. Foreign hard particles with a diameter greater than the refiner gap thereby can cause great damage on the refining elements, but also small particles subject the refining elements to wear.

When the leading bar edge due to wear is rounded off, the energy demand for manufacturing a desired pulp quality increases. The degree of working, and thereby the pulp quality, depend on the refiner gap, the size of which is controlled so that the desired pulp quality shall be obtained. With increased and uneven wear of the bar edges problems arise to maintain the desired pulp quality, which means that the refining elements must be exchanged.

The wear down of bars is an especially great problem at the manufacture of fiberboard pulp where the fibrous material often includes many impurities, for example stones and sand. The refining elements must be exchanged when they are worn, which implies a shutdown of the process. It is, therefore, desired to maintain the sharpness of the bar edges for as long as possible.

The present invention offers a solution of the aforesaid problems. According to the invention it is, thus, possible to use refining elements for a longer time without increased energy demand and with maintained pulp quality. By forming at least one step in the upper surfaces of the bars, at least two longitudinal edges located at different heights on the bars are formed. This means that initially the uppermost edge is active and subjected to wear. As the uppermost edge gradually gets worn, the edge work is taken over by the bar edge located nearest downward on the step. Hereby the service life for the refining element call be extended substantially.

The steps can extend, for examples along the entire length of the bars or be broken by small portions without step in the longitudinal direction of the bars. Each step can have along the bars a constant or varying depth into the upper surfaces of the bars. Tile steps can be formed on only one or on both sides of the bars. Preferably a single step is provided on a bar, but in certain cases two or more steps can be formed.

When steps are formed only on one side of the bars, the rotation direction of the refining discs carrying the refining elements cannot be changed. With regard to strength, however, this may still be suitable design.

The characterizing features of the invention are apparent from the attached claims. The invention is described in greater detail in the following, with reference to the accompanying drawing illustrating some embodiments of the invention.

FIG. 1 shows the front side of a refining element with a pattern of bars and intermediate grooves, FIGS. 2–5 show the upper surface of the bars with different design, FIG. 6 is a cross-section of a bar according to FIGS. 2–4, FIG. 7 is a cross-section of a bar according to FIG. 5.

In FIG. 1 a refining element 10 is shown, which is provided with a pattern of bars 11 and intermediate grooves 12, where the bars have upper surfaces 13 with edges 14. The pattern is divided into two zones, an inner one 15 and an outer one 16. The bars and grooves in the inner zone are coarser than in the outer zone. The bars in the inner zone are intended to bring about a first disentegration of the material and to advance the material outward to the outer zone. The bars in the outer zone are arranged more densely, which implies more bar edges for effecting the substantial defibration and working of the material. The pattern call also comprise more zones, in which case the pattern usually is made more dense from one zone to another, radially outward.

In FIG. 2 an embodiment of a bar 11 on a refining element according to the invention is shown. Along the bar 11 a step 17 extends which is located downwardly of the upper surface 13 of the bar. The difference in level shall be one or some mm, preferably 2–5 mm. Thereby, two longitudinal edges located on different heights are formed, viz the edge 14 on the upper surface of the bar and the edge 18 on the step 17. The step 17 has a constant depth into the bar, but along the bar is broken by small portions 19 without step, in order to improve the strength of the bar 11. The transition from the step 17 to the level located above on the bar suitably is rounded, as appears from FIG. 6, in order to give optimum strength to the bar.

In FIG. 3 another embodiment of the bar is shown. It differs from FIG. 2 in that the step 20 has a varying depth along the bar into the upper surface 13 of the bar.

In FIG. 4 an embodiment with steps 21 on both sides of the bar 11 is shown. This implies that a refining element with such bars can rotate in both directions.

In FIGS. 5 and 7 another alternative of a bar with two steps 22, 23 on different levels is shown, where on the bar an additional edge 24 on the lowest step 23 is formed. It is, of course, furthermore possible to combine the shown embodiment of bars in a suitable way on a refining element.

Bars designed according to the invention can be arranged in any zone oil the refining element, but preferably in an outer zone where the defibration and working is most intensive, and the distance between opposed refining elements is shortest, i.e. the refiner gap is smallest.

The invention, of course, is not restricted to the embodiments shown, but can be varied within the scope of the claims with reference to the description and Figures.

What is claimed is:

1. A refining element for use in a disk refiner, said refining element including an outer surface including a plurality of raised bars separated by a plurality of grooves therebetween, said plurality of raised bars including an upper surface defining a first longitudinal edge and at least one step defining a second longitudinal edge at an intermediate height between said first longitudinal edge and said outer surface of said refining element, said second longitudinal edge being interrupted by at least one intermediate portion which does not include said at least one step.

2. The refining element of claim 1 wherein said first and second longitudinal edges extend along the entire length of said plurality of raised bars.

3. The refining element of claim 1 wherein said second longitudinal edge extends along the entire length of said plurality of raised bars.

4. The refining element of claim 1 wherein said at least one step defines a constant depth into said plurality of raised bars.

5. The refining element of claim 1 wherein said at least one step defines a variable depth into said plurality of raised bars along the length of said plurality of raised bars.

6. The refining element of claim 1 wherein said first longitudinal edge is continuous along the entire length of said plurality of raised bars.

7. The refining element of claim wherein said first longitudinal edge is disposed on one side of said plurality of raised bars and said at least one step defines said second longitudinal edge along a second side of said plurality of raised bars, and including at least one additional step defining a third longitudinal edge on said first side of said plurality of raised bars.

8. A refining element for use in a disks refiner, said refining element including an outer surface including a plurality of raised bars separated by a plurality of grooves therebetween, said plurality of raised bars including an upper surface defining a first longitudinal edge and at least one step defining a second longitudinal edge at an intermediate height between said first longitudinal edge and said outer surface of said refining element, said at least one step defining a variable depth into said plurality of raised bars along the length of said plurality of raised bars.

9. The refining element of claim 8 wherein said first and second longitudinal edges extend along the entire length of said plurality of raised bars.

10. The refining element of claim 8 wherein said second longitudinal edge extends along the entire length of said plurality of raised bars.

11. The refining element of claim 8 wherein said at least one step defines a constant depth into said plurality of raised bars.

12. The refining element of claim 8 wherein said first longitudinal edge is continuous along the entire length of said plurality of raised bars.

13. The refining element of claim 8 wherein said first longitudinal edge is disposed on one side of said plurality of raised bars and said at least one step defines said second longitudinal edge of a second side of said plurality of raised bars, and including at least one additional step defining a third longitudinal edge on said first side of said plurality of raised bars.

14. The refining element of claim 8 wherein said second longitudinal edge is interrupted by at least one intermediate portion which does not include said at least one step.

15. A refining element for use in a disk refiner comprising a pair of opposed refining elements, said refining elements being adapted to rotate in a first predetermined direction and including an outer surface including a plurality of raised bars separated by a plurality of grooves therebetween, said plurality of raised bars including a leading edge facing in said predetermined direction and a trailing edge and an upper surface defining a first longitudinal edge at said leading edge and at least one step defining a second longitudinal edge at said leading edge at an intermediate height between said first longitudinal edge and said outer surface of said refining element, said at least one step defining a variable depth into said raised bars along the length of said plurality of raised bars.

16. A refining element for use in a disk refiner comprising a pair of opposed refining elements, said refining elements being adapted to rotate in a first predetermined direction and including an outer surface including a plurality of raised bars separated by a plurality of grooves therebetween, said plurality of raised bars including a leading edge facing in said predetermined direction and a trailing edge and an upper surface defining a first longitudinal edge disposed on said leading edge side of said plurality of raised bars and at least one step defining a second longitudinal edge along said trailing edge of said plurality of raised bars at an intermediate height between said first longitudinal edge and said outer surface of said refining element, and including at least one additional step defining a third longitudinal edge on said leading edge of said plurality of raised bars.

* * * * *

UNITED STATES PATENT AND TRADEMARK OFFICE

CERTIFICATE OF CORRECTION

PATENT NO. : 6,592,062 B1
DATED : July 15, 2003
INVENTOR(S) : Nils Virving

It is certified that error appears in the above-identified patent and that said Letters Patent is hereby corrected as shown below:

Columns 1-4,
Delete the specification and substitute therefor the following enclosed specification.

Column 3,
Line 43, after “claim” insert -- 1 --.
Line 50, “disks” should read -- disk --.

It is certified that error appears in the above-identified patent and that said Letters Patent is hereby corrected as shown below:

REFINING ELEMENT

FIELD OF THE INVENTION

[0001] The present invention relates to refiners of the disk type, with opposed refining disks rotating relative to each other. More particularly, the present invention relates to refining disks provided with refining elements, which form a refiner gap therebetween, with a refiner zone for the working of fibrous material. The fibrous material preferably is lignocellulosic fiber material, and the refiner is used for manufacturing, for example, reject pulp, recycled fiber pulp and mechanical pulps such as board pulp, thermomechanical pulp (TMP) and chemi-thermomechanical pulp (CTMP) as well as chemical pulps. Still more particularly the present invention relates to a refining element for use in a refiner of the aforesaid type.

BACKGROUND OF THE INVENTION

[0002] Refining elements are generally designed with a pattern of bars and intermediate grooves. The bars and grooves are formed in different ways, depending on the fibrous material to be worked and on the degree of working required. Thus, in the case of lignocellulosic material, this depends on the pulp quality which is desired. The bars, for example, can be continuous or discontinuous, and they can be arranged in different patterns.

[0003] The refiner gap is generally designed so that the fibrous material passes from the inside out, as seen in radial direction. Farthest inward in the refiner gap the refining elements are normally designed to bring about a first disintegration of the material, and to advance the material further outward in the refiner gap. A certain defibration, i.e. separation of the fibers of the lignocellulosic material, also takes place in the inner portion of the refiner gap where the distance between the refining surfaces is greatest. Thereafter, the distance decreases outwardly in order to achieve the desired working of the fibrous material.

It is certified that error appears in the above-identified patent and that said Letters Patent is hereby corrected as shown below:

[0004] The working of the fibrous material is substantially carried out by the bars of the refining elements. Their design is therefore of essential importance for the pulp quality. Other factors of influence on the pulp quality are, for example, the size of the refiner gap, the liquid contents in the fibrous material, the feed, the temperature, etc.

[0005] The bars have an upper surface with edges. During the working of the fibrous material the bars are worn, especially along their edges, which thereby become rounded. In cases where one refiner disk is stationary, its bars most often become worn the most, because the difference in speed between the fibrous material and the stationary refiner disk is greater than the difference in speed between the fibrous material and the rotating refiner disks.

[0006] This wear is primarily caused by the fact that sand and other hard foreign particles follow along with the fibrous material into the refiner and, thus, into the refiner gap where they repeatedly come into contact with the bars of the refining elements.

[0007] The refiner disks normally have a rotational speed of up to about 3,000 revolutions per minute relative to each other, and the refiner gap normally has a size of about 0.2 to 2 mm. Foreign hard particles with a diameter greater than the refiner gap thereby can cause great damage on the refining elements, but small particles will also subject the refining elements to considerable wear.

[0008] When the leading edge of the bar is rounded off due to wear, the energy demand for manufacturing a desired pulp quality increases. The degree of working, and thus the pulp quality, depend on the refiner gap, the size of which is controlled so that the desired pulp quality can be obtained. With increased and uneven wear of the bar edges problems arise in order to maintain the desired pulp quality, which means that the refining elements must be exchanged.

[0009] The wearing down of these bars is an especially great problem during the manufacture of fiberboard pulp where It is certified that error appears in the above-identified patent and that said Letters Patent is hereby corrected as shown below:

the fibrous material often includes many impurities, for example stones and sand. The refining elements must be exchanged when they are worn, which thus requires a shutdown of the process. It is, therefore, desired to maintain the sharpness of the bar edges for as long as possible.

SUMMARY OF THE INVENTION

[0010] These and other problems have now been overcome by the invention of a refining element for use in a disk refiner, the refining element including an outer surface including a plurality of raised bars separated by a plurality of grooves therebetween, the plurality of raised bars including an upper surface defining a first longitudinal edge and at least one step defining a second longitudinal edge at an intermediate height between the first longitudinal edge and the outer surface of the refining element. In a preferred embodiment, the first and second longitudinal edges extend along the entire length of the plurality of raised bars.

[0011] In accordance with one embodiment of the refining element of the present invention, the second longitudinal edge extends along the entire length of the plurality of raised bars.

[0012] In accordance with another embodiment of the refining element of the present invention, the second longitudinal edge is interrupted by at least one intermediate portion which does not include the at least one step.

[0013] In accordance with another embodiment of the refining element of the present invention, the at least one step defines a constant depth into the plurality of raised bars.

[0014] In accordance with another embodiment of the refining element of the present invention, the at least one step defines a variable depth into the plurality of raised bars along the length of the plurality of raised bars.

[0015] In accordance with yet another embodiment of the refining element of the present invention, the first It is certified that error appears in the above-identified patent and that said Letters Patent is hereby corrected as shown below:

longitudinal edge is continuous along the entire length of the plurality of raised bars.

[0016] In accordance with another embodiment of the refining element of the present invention, the first longitudinal edge is disposed on one side of the plurality of raised bars and the at least one step defines the second longitudinal edge along a second side of the plurality of raised bars, and including at least one additional step defining a third longitudinal edge on the first side of the plurality of raised bars.

[0017] According to the present invention it is possible to use refining elements for a longer period of time without increased energy demand, and while maintaining pulp quality. By forming at least one step in the upper surfaces of the bars, at least two longitudinal edges are formed, located at different heights on the bars. This means that, initially, the uppermost edge is active and subjected to wear. As the uppermost edge gradually becomes worn, the edge work is taken over by the bar edge located nearest downwardly on the step. In this manner, the service life for the refining element can be extended substantially.

[0018] The steps can extend, for example, along the entire length of the bars, or they can be broken by small portions without such a step in the longitudinal direction of the bars. Each step can have a constant or varying depth along the bars, and into the upper surfaces of the bars. The steps can be formed on only one or on both sides of the bars. Preferably, a single step is provided on a bar, but in certain cases two or more steps can be formed.

[0019] When steps are formed only on one side of the bars, the rotational direction of the refining disks carrying the refining elements cannot be changed. With regard to strength, however, this may still be suitable design.

BRIEF DESCRIPTION OF THE DRAWINGS

[0020] The present invention is described in greater detail in the following detailed description, with reference to the It is certified that error appears in the above-identified patent and that said Letters Patent is hereby corrected as shown below.

accompanying drawing illustrating embodiments of the present invention, which, in turn, refer to the drawings, in which.

[0021]

[0022]

[0023]

[0024]

[0025]

[0026]

[0027]

DETAILED DESCRIPTION

Figure 1:
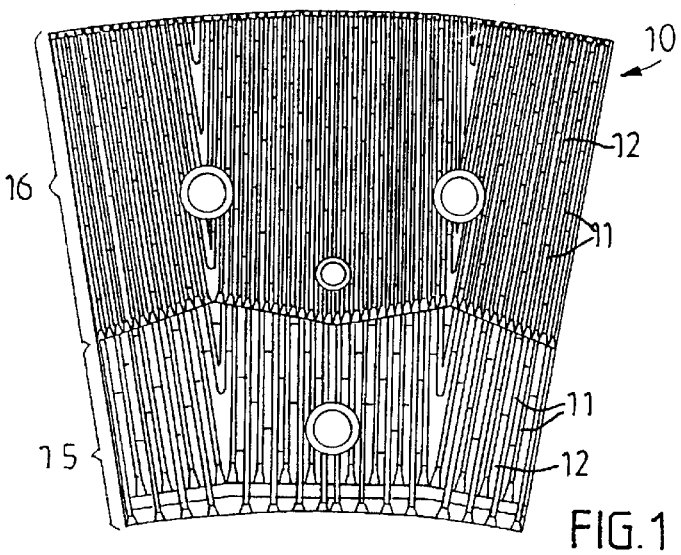
Fig. 1 is a front, elevational view of a refining element with a pattern of bars and intermediate grooves.

[0028] Referring to the Figures, in which like reference numerals refer to like elements thereof, Fig. 1 shows a refining element 10, which is provided with a pattern of bars 11 and intermediate grooves 12, in which the bars have upper surfaces 13 with edges 14. The pattern is divided into two zones, an inner one 15 and an outer one 16. The bars and grooves in the inner zone are coarser than those in the outer zone. The bars in the inner zone are intended to bring about a first disintegration of the material and to advance the material outward to the outer zone. The bars in the outer zone are arranged more densely, which provides for more bar edges for effecting the substantial defibration and working of the material. The pattern can also comprise more zones, in which case the pattern is usually made more dense from one zone to another, in a radially outward direction.

Figure 2:
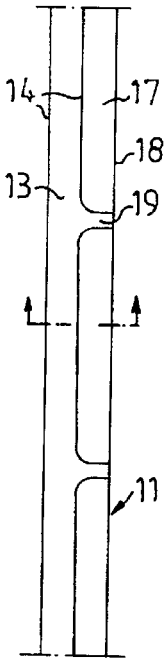
Fig. 2 is a front, elevational, enlarged view of the upper surface of the bars on a refining element of the present invention, with a first design.
Figure 6:
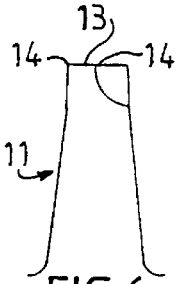
Fig. 6 is a side, elevational, cross-sectional view of the upper surface of the bar shown in Fig. 2.

It is certified that error appears in the above-identified patent and that said Letters Patent is hereby corrected as shown below:

[0029] In Fig. 2 an embodiment of a bar 11 on a refining element according to the present invention is shown. A step 17 extends along the bar 11 and the step 17 is located downwardly of the upper surface 13 of the bar. The difference in level shall be one or more mm, preferably 2 to 5 mm. In this manner, two longitudinal edges located on different heights are formed, for example the edge 14 on the upper surface of the bar and the edge 18 on the step 17. The step 17 has a constant depth into the bar, but along the bar it is broken up or interrupted by small portions 19 without a step, in order to improve the strength of the bar 11. The transition from the step 17 to the level located above on the bar is preferably rounded, as appears from Fig. 6, in order to provide optimum strength to the bar.

Figure 3:
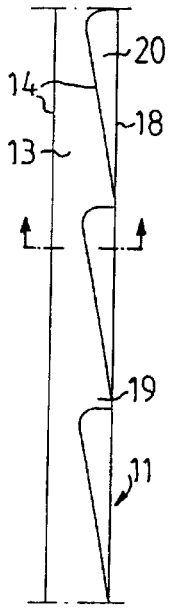
Fig. 3 is a front, elevational, enlarged view of the upper surface of the bars of a refining element of the present invention, with a different design.

[0030] In Fig. 3 another embodiment of the bar is shown. It differs from that shown in Fig. 2 in that the step 20 has a varying depth along the bar into the upper surface 13 of the bar.

Figure 4:
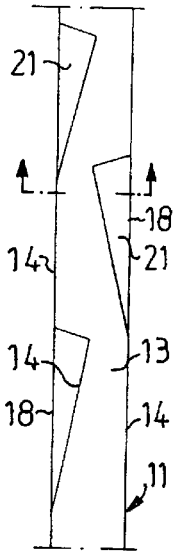
Fig. 4 is a front, elevational, enlarged view of the upper surface of the bars of the refining element of the present invention, with another alternative design.

[0031] In Fig. 4 an embodiment with steps 21 on both sides of the bar 11 is shown. This provides a refining element in which such bars can rotate in both directions.

Figure 5:
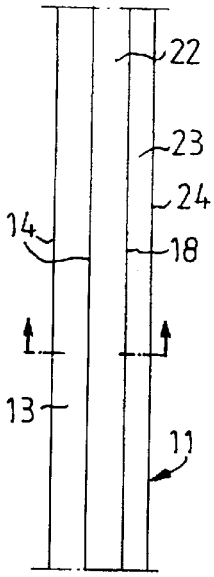
Fig. 5 is a front, elevational, enlarged view of the upper surface of the bars of the refining element of the present invention, with yet another alternative design.
Figure 7:
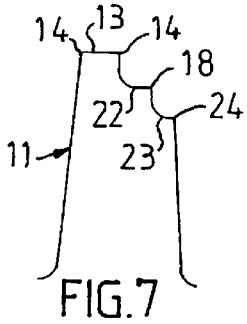
Fig. 7 is a side, elevational, enlarged, cross-sectional view of the bars shown in Fig. 5.

[0032] In Figs. 5 and 7 another alternative of a bar with two steps, 22 and 23, on different levels is shown, where on the bar an additional edge 24 on the lowest step 23 is formed. It is, of course, further possible to combine the various embodiments of bars in a suitable manner on a refining element.

[0033] Bars designed according to the present invention can be arranged in any zone on the refining element, but are preferably in an outer zone, where the defibration and working is most intensive, and the distance between opposed refining elements is shortest, i.e. the refiner gap is smallest.

[0034] Although the invention herein has been described with reference to particular embodiments, it is to be understood that these embodiments are merely illustrative of the principles and applications of the present invention. It

UNITED STATES PATENT AND TRADEMARK OFFICE

CERTIFICATE OF CORRECTION

PATENT NO. : 6,592,062 B1
DATED : July 15, 2003
INVENTOR(S) : Nils Virving

It is certified that error appears in the above-identified patent and that said Letters Patent is hereby corrected as shown below:

is therefore to be understood that numerous modifications may be made to the illustrative embodiments and that other arrangements may be devised without departing from the spirit and scope of the present invention as defined by the appended claims.

Signed and Sealed this

Sixth Day of January, 2004

JAMES E. ROGAN
*Director of the United States Patent and Trademark Office*